US008659539B2

(12) United States Patent
Hung et al.

(10) Patent No.: US 8,659,539 B2
(45) Date of Patent: Feb. 25, 2014

(54) MULTI-MODE DISPLAY DEVICE HAVING AN AMBIENT LIGHT SENSOR AND POWER-SAVING METHOD OF THE SAME

(75) Inventors: Chi-Ming Hung, Yilan County (TW); Chih-Ming Ma, Taoyuan County (TW); Pei-Cheng Huang, Taoyuan County (TW); Jun-Lin Huang, New Taipei (TW)

(73) Assignee: Quanta Computer Inc., Taoyuan Shien (TW)

( * ) Notice: Subject to any disclaimer, the term of this patent is extended or adjusted under 35 U.S.C. 154(b) by 253 days.

(21) Appl. No.: 13/164,159

(22) Filed: Jun. 20, 2011

(65) Prior Publication Data

US 2012/0256892 A1 Oct. 11, 2012

(30) Foreign Application Priority Data

Apr. 8, 2011 (TW) ..... 100112248 A

(51) Int. Cl.
*G09G 3/36* (2006.01)

(52) U.S. Cl.
USPC ..... 345/102; 345/207

(58) Field of Classification Search
USPC ..... 345/102, 207
See application file for complete search history.

(56) References Cited

U.S. PATENT DOCUMENTS

| | | | | |
|---|---|---|---|---|
| 2005/0140641 | A1* | 6/2005 | Kim et al. | 345/102 |
| 2009/0140971 | A1* | 6/2009 | Hernandez et al. | 345/102 |
| 2010/0149469 | A1* | 6/2010 | Hunt | 349/114 |
| 2010/0225640 | A1* | 9/2010 | Vieri et al. | 345/214 |
| 2012/0194493 | A1* | 8/2012 | Soto | 345/207 |

* cited by examiner

*Primary Examiner* — Long D Pham
(74) *Attorney, Agent, or Firm* — Rabin & Berdo, P.C.

(57) ABSTRACT

A power-saving method adapted in a multi-mode display device is provided. The power-saving method comprises the steps as follows. A brightness of an ambient light is detected. When the brightness of the ambient light lies within a transmissive range, the multi-mode display device is operated in a transmissive mode and enables the backlight module of the multi-mode display. When the brightness of the ambient light lies within a transflective range, the multi-mode display device is operated in a transflective mode and the brightness of the backlight module is dynamically adjusted according to a compensation method. When the brightness of the ambient light lies within a reflective range, the multi-mode display device is operated in a reflective mode and turns off the backlight module.

10 Claims, 3 Drawing Sheets

| Brightness of ambient light (lux) | 30 | 100 | 200 | 300 | 400 | 500 | 700 |
|---|---|---|---|---|---|---|---|
| High-state width ratio in conventional display device(%) | 20 | 35 | 50 | 60 | 70 | 80 | 100 |
| High-state width ratio in multi-mode display device(%) | 20 | 30 | 40 | 35 | 30 | 20 | 0 |

MULTI-MODE DISPLAY DEVICE HAVING AN AMBIENT LIGHT SENSOR AND POWER-SAVING METHOD OF THE SAME

RELATED APPLICATIONS

This application claims priority to Taiwan Application Serial Number 100112248, filed Apr. 8, 2011, which is herein incorporated by reference.

BACKGROUND

1. Technical Field

The present disclosure relates a display device. More particularly, the present disclosure relates to a multi-mode display device and a power-saving method of the same.

2. Description of Related Art

The size of the mobile communication device reduces along with the technology progress. How to reduce the power-consumption in the smaller mobile communication device to extend its time for using becomes an important issue.

The screen is an indispensable component of the mobile communication device. However, the screen is also the most power-consuming module in the mobile communication device. In order to make the user view the screen clearly under different light environments, the brightness of the ambient light is sensed such that the brightness of the backlight module is increased when the brightness of the ambient light increases in the conventional design. The increase of the brightness of the backlight makes the power consumed by the screen raise at the same time. The time for using of the mobile communication device reduces rapidly since the mobile communication device can only adapt a small battery module with a small amount of power.

Accordingly, what is needed is a multi-mode display device and a power-saving method of the same to overcome the above issues. The present disclosure addresses such a need.

SUMMARY

An aspect of the present disclosure is to provide a power-saving method adapted in a multi-mode display device, wherein the power-saving method comprises the following steps. A brightness of an ambient light is detected. The multi-mode display device is operated in a transmissive mode and a backlight module of the multi-mode display is enabled when the brightness of the ambient light lies within a transmissive range. The multi-mode display device is operated in a transflective mode and a backlight brightness of the backlight module of the multi-mode display is dynamically adjusted according to a compensation method when the brightness of the ambient light lies within a transflective range. The multi-mode display device is operated in a reflective mode and the backlight module is turned off when the brightness of the ambient light lies within a reflective range.

Another aspect of the present disclosure is to provide a multi-mode display device. The multi-mode display device comprises a backlight module, an ambient light sensor, a panel module and a control module. The backlight module provides a backlight with a backlight brightness. The ambient light sensor detects a brightness of the ambient light. The panel module displays a frame with a displayed brightness according to the brightness of the ambient light and the backlight brightness. The control module retrieves the brightness of the ambient light and to determine the range that the brightness of the ambient light lies within to further operate the multi-mode display device in a transmissive mode and enabling a backlight module of the multi-mode display when the brightness of the ambient light lies within a transmissive range, operate the multi-mode display device in a transflective mode and dynamically adjusting a backlight brightness of the backlight module of the multi-mode display according to a compensation method when the brightness of the ambient light lies within a transflective range and operate the multi-mode display device in a reflective mode and turning off the backlight module when the brightness of the ambient light lies within a reflective range.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
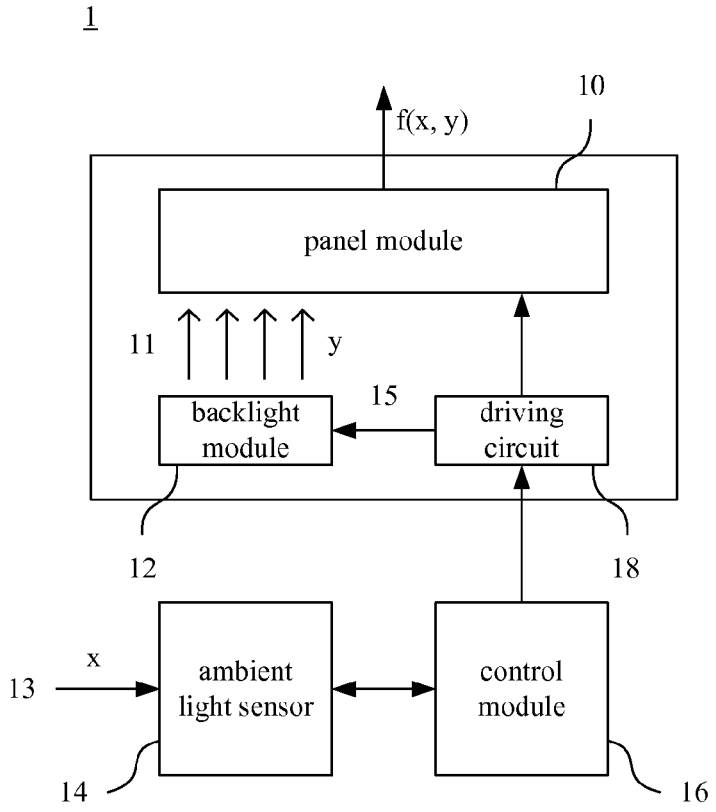
FIG. 1 is a block diagram of a multi-mode display device in an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Please refer to FIG. 1. FIG. 1 is a block diagram of a multi-mode display device 1 in an embodiment of the present disclosure. The multi-mode display device 1 comprises a panel module 10, a backlight module 12, an ambient light sensor 14, a control module 16 and a driving circuit 18.

The multi-mode display device 1 can be adapted in different electronic devices (not shown) such as desktops, notebooks or mobile communication devices including cell phone, flat-panel PC and personal digital assistant. The data or information of the electronic device can be displayed on the panel module 10. The backlight module 12 provides a backlight 11 with a backlight brightness to the panel module 10 such that the user can view the content or information displayed on the panel module 10. The driving circuit 18 controls the panel module 10 to update the content displayed on the panel module 10 and controls the brightness of the backlight 11 from the backlight module 12.

It's noticed that the term "multi-mode" described above means that the panel module 10 can be operated in a transmissive mode, a reflective mode and a transflective mode under different circumstances. In the transmissive mode, the backlight 11 from the backlight module 12 passes through the panel module 10 such that the user can clearly view the panel module 10. In other words, the light that let the user could view the panel module 10 is mainly from the backlight 11 from the backlight module 12 passing through the panel module 10. In the reflective mode, a reflective board (not shown) disposed in the panel module 10 reflects the ambient light that is incident to the panel module 10 such that the user can clearly view the panel module 10. In other words, the light that let the user could view the panel module 10 is mainly from the ambient light reflected by the reflective board. In the transflective mode, the user views the panel module 10 through the use of both the backlight 11 and the ambient light. For example, 50% of the light perceived by the user is provided by the backlight module 12 and 50% of the light perceived by the user is provided by the reflected ambient light.

The ambient light sensor 14 detects the brightness of the ambient light 13. The brightness of the ambient light 13 varies according different positions of the multi-mode display device 1. For example, if the user stays in a room with insufficient illumination, the brightness of the ambient light 13 becomes low. On the contrary, if the user stays outdoors under the fierce sunlight, the brightness of the ambient light 13 becomes high. The brightness of the ambient light 13 can be defined by the unit of nit (one candela per square meter) or lux (one lumen per square meter).

The control module 16 can retrieve the brightness of the ambient light 13 actively or passively. In an embodiment, the control module 16 can actively acquire the sensor information by polling the ambient light sensor 14 periodically such that the ambient light sensor 14 transfers the sensed brightness value to the control module 16 every fixed time interval. In another embodiment, the control module 16 passively acquires the sensor information by receiving an interrupt from the ambient light sensor 14, wherein the ambient light sensor 14 generates the interrupt when it determines that the variation of the brightness exceeds a threshold value. The passive acquiring method can avoid unnecessary polling that consume lots of power when the user stays in an environment having stable brightness. In other embodiments, the control module 16 can also make use of other designs, whether in an active way or in a passive way, to retrieve the brightness of the ambient light 13 from the ambient light sensor 14.

Figure 2:
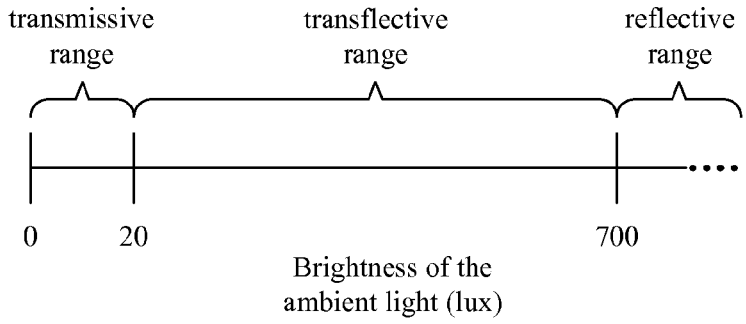
FIG. 2 is a diagram of the range of the brightness of the ambient light in an embodiment of the present disclosure.

The control module 16 further determines the operation mode of the panel module 10 according to the brightness of the ambient light 13. Please refer to FIG. 2. FIG. 2 is a diagram of the range of the brightness of the ambient light 13 in an embodiment of the present disclosure. In an embodiment, the brightness of the ambient light 13 measured by the unit of lux can be distinguished into three different ranges. The value of the brightness smaller than about 20 lux is defined as transmissive range. The value of the brightness larger than about 700 lux is defined as reflective range. The value of the brightness ranging from 20 to 700 lux is defined as transflective range.

The control module 16 adjusts the operation mode of the panel module 10 and the backlight module 12 in the multi-mode display device 1 according to the range that the brightness of the ambient light lies within. When the brightness of the ambient light 13 lies within the transmissive range, it means that the brightness of the ambient light 13 is in a low range such that the control module 16 set or operate the multi-mode display device 1 in the transmissive mode and enables the backlight module 12. Hence, in the state, the light that the user can view the content on the panel module 10 is mainly from the backlight 11 from the backlight module 12, thus the displayed brightness of the panel module 10 is about the same as the brightness of the backlight 11 from the backlight module 12.

When the brightness of the ambient light 13 lies within the reflective range, it means that the brightness of the ambient light 13 is in a high range such that the control module 16 set the multi-mode display device 1 in the reflective mode. In the state, the control module 16 turns off the backlight module 12 due to the ambient light 13 reflected is high enough to let the user view the content on the panel module 10. In other words, the light that the user can view the panel module 10 is mainly from the reflected ambient light 13, thus the displayed brightness of the panel module 10 is about the same as the reflected ambient light 13.

When the brightness of the ambient light 13 lies within the transflective range, it means that the brightness of the ambient light 13 is in a middle range such that the control module 16 set the multi-mode display device 1 in the transflective mode. In the state, the control module 16 further controls the backlight module 12 to dynamically adjust the brightness of the backlight 11 according to a compensation method.

In an embodiment, the control module 16 controls the driving circuit 18 to adjust the backlight module 12. The driving circuit 18 makes use of the pulse width modulation method to provide a pulse width modulation signal 15 to the backlight module 12. The backlight module 12 further adjusts the brightness of the backlight according to a high-state width ratio of the pulse width modulation signal 15. For example, when the ratio of the high state in one period becomes higher, the brightness of the backlight module 12 increases, and when the ratio of the high state in one period becomes lower, the brightness of the backlight module 12 decreases.

The control module 16 can dynamically adjust the brightness of the backlight 11 through the control of the driving circuit 18 based on the brightness of the ambient light 13 and a pre-stored brightness look-up table when the brightness of the ambient light 13 lies within the transflective range. Suppose that the brightness of the ambient light is x and the backlight brightness provided by the backlight module 12 according to the high-state width ratio is y, the displayed brightness of the panel module 10 is represented as a function f(x, y). In an embodiment, the function f(x, y) is expressed as:

$$f(x, y) = \begin{cases} y, & 0 < x \leq 30 \\ 20 + (x/10), & 30 < x \leq 200 \\ x \times (-13/60) + y \times (5/3), & 200 < x \leq 400 \\ x \times (-1/3) + y \times (7/3), & 400 < x \end{cases}$$

The brightness look-up table can be established according to the above function, wherein the unit of the brightness of the ambient light 13, the brightness of the backlight 11 and the displayed brightness is lux. After the control module 16 determines that the brightness of the ambient light 13 retrieved from the ambient light sensor 14 lies within the transflective range, the control module 16 adjusts the brightness of the backlight 11 according to the brightness of the ambient light 13 and the brightness look-up table. The displayed brightness of the panel module 10 is the sum of the brightness of the reflected ambient light 13 and the brightness of the backlight 11. Consequently, when the brightness of the ambient light 13 in the transflective range is higher, there are greater amount of the ambient light that can be reflected and the brightness of the backlight 11 can be reduced.

Accordingly, in contrast to the conventional design that increases the brightness of the backlight when the brightness of the ambient light becomes higher, the multi-mode display device 1 in the present disclosure turns off the backlight module when the brightness of the ambient light is beyond a threshold value and dynamically adjusts the brightness of the backlight from the backlight module according to the brightness of the ambient light when the brightness of the ambient light lies within a middle range. The power-saving mechanism can thus be accomplished since the total power consumption of the backlight module is greatly reduced.

Figure 3:
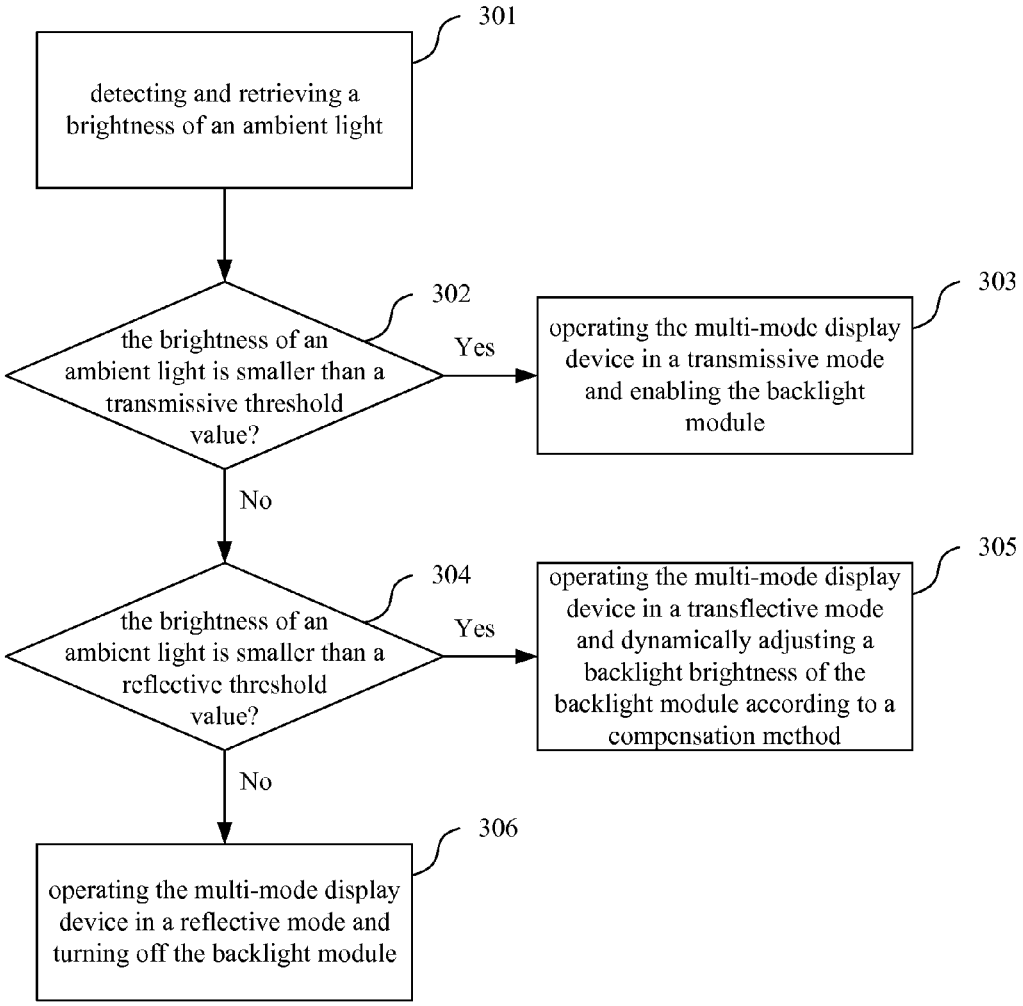
FIG. 3 is a flow chart of a power-saving method in an embodiment of the present disclosure.

Please refer to FIG. 3. FIG. 3 is a flow chart of a power-saving method in an embodiment of the present disclosure. The power-saving method can be adapted in the multi-mode display device 1 depicted in FIG. 1. The power-saving method comprises the following steps. (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 301, the ambient light sensor 14 detects the brightness of the ambient light 13 and the control module 16 retrieves the brightness of the ambient light 13 from the ambient light sensor 14. In step 302, the control module 16 determines whether the brightness of the ambient light 13 is smaller than a transmissive threshold value. When the brightness of the ambient light 13 is smaller than the transmissive threshold value (i.e. the brightness of the ambient light 13 lies within the transmissive range), the control module 16 set the multi-mode display device 1 in the transmissive mode and enables the backlight module 12.

If the determination result in step 302 is that the brightness of the ambient light 13 is not smaller than the transmissive threshold value, the control module 16 continues to determine whether the brightness of the ambient light 13 is smaller than a reflective threshold value in step 304. When the brightness of the ambient light 13 is smaller than the reflective threshold value (i.e. the brightness of the ambient light 13 that is larger than the transmissive threshold value and is smaller than the reflective threshold value lies within the transflective range), the control module 16 set the multi-mode display device 1 in the transflective mode and the backlight brightness of the backlight module 12 is dynamically adjusted according to a compensation method in step 305.

If the determination result in step 304 is that the brightness of the ambient light 13 is not smaller than the reflective threshold value, the control module 16 proceeds to step 306. Since the brightness of the ambient light 13 is larger than the reflective threshold value (i.e. within the reflective range), the control module 16 set the multi-mode display device 1 in the reflective mode and turns off the backlight module 12 in step 306.

Figures 4, 5:
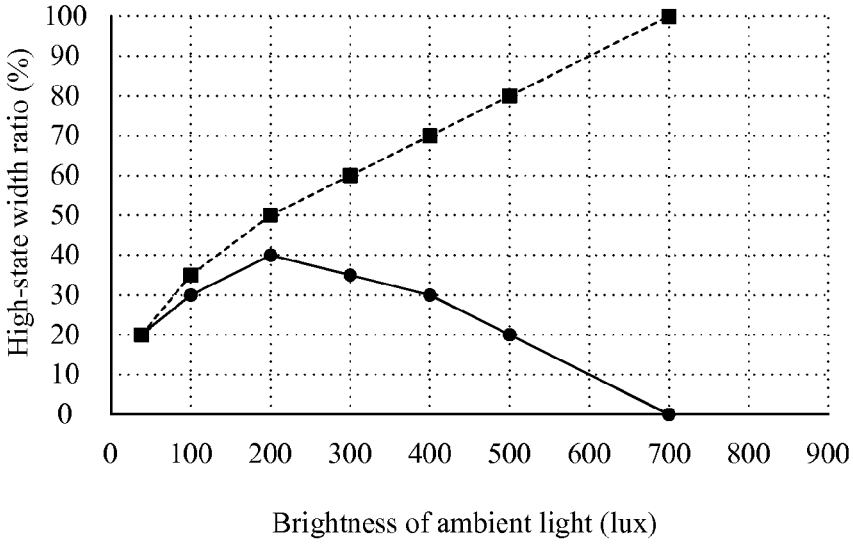
FIG. 4 is a diagram depicting curves showing the relation between the brightness of the ambient light (lux) and the high-state width ratio (%) of the pulse width modulation signal provided by the driving circuit.
FIG. 5 is a table of the relation between the brightness of the ambient light and the high-state width ratio.

Please refer to FIG. 4 and FIG. 5 at the same time. FIG. 4 is a diagram depicting curves showing the relation between the brightness of the ambient light (lux) and the high-state width ratio (%) of the pulse width modulation signal provided by the driving circuit. FIG. 5 is a table of the relation between the brightness of the ambient light and the high-state width ratio.

In FIG. 4, the curve that includes a plurality of connected square-shaped points shows how the high-state width ratio varies in accordance to the brightness of the ambient light in a conventional display device. The curve that includes a plurality of connected round points shows how the high-state width ratio varies in accordance to the brightness of the ambient light in the multi-mode display device of the present disclosure. Referring to the statistic in the table of FIG. 5, it's obvious that the brightness of the backlight module in the conventional design gradually increases when the brightness of the ambient light rises. On the contrary, the backlight module in the multi-mode display device of the present disclosure decreases the brightness of the backlight when the brightness of the ambient light rises, thus accomplish a power-saving mechanism.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A power-saving method adapted in a multi-mode display device, wherein the power-saving method comprises the steps of:

detecting a brightness of an ambient light;

operating the multi-mode display device in a transmissive mode and enabling a backlight module of the multi-mode display when the brightness of the ambient light lies within a transmissive range;

operating the multi-mode display device in a transflective mode and dynamically adjusting a backlight brightness of the backlight module of the multi-mode display according to a compensation method when the brightness of the ambient light lies within a transflective range, wherein the backlight brightness is dynamically adjusted according to the compensation method based on the brightness of the ambient light, a brightness look-up table and control of a high-state width ratio of a pulse width modulation signal such that when the brightness of the ambient light is represented as x, the backlight brightness provided by the backlight module according to a high-state width ratio is represented as y and a displayed brightness of a panel module of the multi-mode display device is represented as a function f(x, y), the function f(x, y) is expressed as:

$$f(x, y) = \begin{cases} y, & 0 < x \le 30 \\ 20 + (x/10), & 30 < x \le 200 \\ x \times (-13/60) + y \times (5/3), & 200 < x \le 400 \\ x \times (-1/3) + y \times (7/3), & 400 < x \end{cases};$$

and operating the multi-mode display device in a reflective mode and turning off the backlight module when the brightness of the ambient light lies within a reflective range.

2. The power-saving method of claim 1, wherein the multi-mode display device is operated in the transmissive mode when the brightness of the ambient light is smaller than a transmissive threshold value, the multi-mode display device is operated in the reflective mode when the brightness of the ambient light is larger than a reflective threshold value, and the multi-mode display device is operated in the transflective mode when the brightness of the ambient light is larger than the transmissive threshold value and smaller than the reflective threshold value.

3. The power-saving method of claim 2, wherein the transmissive threshold value is 20 lux and the reflective threshold value is 700 lux.

4. The power-saving method of claim 1, wherein the step of detecting the brightness of the ambient light further comprises polling an ambient light sensor by a control module of the multi-mode display device.

5. The power-saving method of claim 1, wherein the step of detecting the brightness of the ambient light further comprises generating an interrupt command to a control module of the multi-mode display device by an ambient light sensor.

6. A multi-mode display device comprising:

a backlight module to provide a backlight with a backlight brightness;

an ambient light sensor to detect a brightness of an ambient light;

a panel module with a displayed brightness according to the brightness of the ambient light and the backlight brightness; and a control module to retrieve the brightness of the ambient light, wherein when the brightness of the ambient light lies within a transmissive range, the control module operates the multi-mode display device in a transmissive mode and enables the backlight module of the multi-mode display device, when the brightness of the ambient light lies within a transflective range, the control module operates the multi-mode display device in a transflective mode and dynamically adjusts the backlight brightness of the backlight module of the multi-mode display device according to a compensation method, wherein the backlight brightness is dynamically adjusted according to the compensation method based on the brightness of the ambient light, a brightness look-up table and control of a high-state width ratio of a pulse width modulation signal such that when the brightness of the ambient light is represented as x, the backlight brightness provided by the backlight module according to a high-state width ratio is represented as y and a displayed brightness of a panel module of the multi-mode display device is represented as a function f(x, y), the function f(x, y) is expressed as:

$$f(x, y) = \begin{cases} y, & 0 < x \leq 30 \\ 20 + (x/10), & 30 < x \leq 200 \\ x \times (-13/60) + y \times (5/3), & 200 < x \leq 400 \\ x \times (-1/3) + y \times (7/3), & 400 < x \end{cases},$$

and when the brightness of the ambient light lies within a reflective range, the control module operates the multi-mode display device in a reflective mode and turns off the backlight module.

7. The multi-mode display device of claim 6, wherein the multi-mode display device is operated in the transmissive mode when the brightness of the ambient light is smaller than a transmissive threshold value, the multi-mode display device is operated in the reflective mode when the brightness of the ambient light is larger than a reflective threshold value, and the multi-mode display device is operated in the transflective mode when the brightness of the ambient light is larger than the transmissive threshold value and smaller than the reflective threshold value.

8. The multi-mode display device of claim 7, wherein the transmissive threshold value is 20 lux and the reflective threshold value is 700 lux.

9. The multi-mode display device of claim 6, wherein the control module retrieves the brightness of the ambient light by polling the ambient light sensor.

10. The multi-mode display device of claim 6, the control module retrieves the brightness of the ambient light when the ambient light sensor generates an interrupt command to the control module.

* * * * *